United States Patent [19]

King

[11] Patent Number: 5,037,565

[45] Date of Patent: Aug. 6, 1991

[54] BASIC ALKALI METAL SULFONATE DISPERSIONS, PROCESS FOR THEIR PREPARATION, AND LUBRICANTS CONTAINING SAME

[75] Inventor: Laurence E. King, Painesville, Ohio

[73] Assignee: The Lubrizol Corporation, Wickliffe, Ohio

[21] Appl. No.: 366,669

[22] Filed: Jun. 15, 1989

Related U.S. Application Data

[63] Continuation of Ser. No. 120,244, Nov. 3, 1987, abandoned, which is a continuation of Ser. No. 632,768, Jul. 20, 1984, abandoned, which is a continuation of Ser. No. 543,222, Oct. 20, 1983, abandoned, which is a continuation of Ser. No. 246,837, Mar. 23, 1981, abandoned, which is a continuation of Ser. No. 938,743, Aug. 31, 1978, abandoned, which is a continuation-in-part of Ser. No. 790,373, Apr. 25, 1977, abandoned, which is a continuation-in-part of Ser. No. 404,054, Oct. 5, 1973, abandoned.

[51] Int. Cl.[5] ..... C10M 159/24

[52] U.S. Cl. ..... 252/25; 252/33.4; 252/40.7

[58] Field of Search ..... 252/33, 33.3, 25, 40.7

[56] References Cited

U.S. PATENT DOCUMENTS

| | | | |
|---|---|---|---|
| 3,429,811 | 2/1969 | Robbins et al. | 252/33 |
| 3,515,669 | 6/1970 | LeSuer | 252/39 |
| 3,539,511 | 11/1970 | Sabol et al. | 252/33 |
| 3,544,463 | 12/1970 | Koft | 252/40.7 |

*Primary Examiner*—Jacqueline V. Howard
*Attorney, Agent, or Firm*—Joseph P. Fischer; Frederick D. Hunter; James L. Cordek

[57] ABSTRACT

Solutions or substantially stable dispersions of basic alkali metal sulfonates in an inert organic diluent are prepared by intimately contacting an acidic gaseous material such as carbon dioxide with a reaction mixture comprising a sulfonic acid, an alkali metal, an alcohol and a carboxylic acid. The products are useful as additives for lubricants and fuels.

12 Claims, No Drawings

BASIC ALKALI METAL SULFONATE DISPERSIONS, PROCESS FOR THEIR PREPARATION, AND LUBRICANTS CONTAINING SAME

This application is a continuation of application Ser. No. 07/120,244, filed Nov. 3, 1987 now abandoned, which is a continuation of Ser. No. 632,768, filed July 20, 1984, now abandoned, which is a continuation of Ser. No. 543,222, filed Oct. 20, 1983, now abandoned, which is a continuation of Ser. No. 246,837, filed Mar. 23, 1981, now abandoned, which is a continuation of Ser. No. 938,743, filed Aug. 31, 1978, now abandoned, which is a continuation-in-part of Ser. No. 790,373, filed Apr. 25 1977, now abandoned, which is a continuation-in-part of Ser. No. 404,054, filed Oct. 5, 1973, now abandoned.

This invention relates to new compositions of matter, a method for their preparation, and lubricants and fuels containing them. The invention may be briefly characterized as a stable oil-soluble dispersion of basic alkali metal sulfonates having metal ratios of at least about 4 prepared by the process which comprises intimately contacting for a period of time sufficient to form the desired dispersion, at a temperature between the solidification temperature of the reaction mixture and its decomposition temperature:

(A) At least one acidic gaseous material selected from the group consisting of carbon dioxide, hydrogen sulfide, sulfur dioxide, and mixtures thereof, with (B) A reaction mixture comprising (i) at least one oil-soluble sulfonic acid, or derivative thereof susceptible to overbasing;

(ii) at least one alkali metal or basic alkali metal compound;

(iii) at least one lower aliphatic alcohol; and (iv) at least one oil-soluble carboxylic acid or functional derivative thereof.

Solutions and/or substantially stable dispersions of basic metal-containing compositions, and various methods for their preparation, are well known in the art. They are variously referred to by such names as "basic", "complex", "superbased" and "overbased" salts, and the method for their preparation is commonly referred to as "overbasing".

The chief property these basic salts have in common is that they contain metal in amounts that are in excess, frequently substantially in excess, of those equivalent to the organic anion. The term "metal ratio" is often used to define the quantity of metal in these basic salts relative to the quantity of organic anion, and is defined herein as the ratio of the number of equivalents of metal to the number of equivalents thereof which would be present in a normal salt based upon the usual stoichiometry of the compounds involved.

These basic salts are known to be useful as detergents and corrosion inhibitors in lubricants, particularly those used in internal combustion engines, and as smoke suppressants and anti-screen clogging agents for petroleum distillate fuels, especially diesel fuels. The basic salts and their utility in lubricants and fuels are described in a number of U.S. Pat. Nos. including the following:

| | |
|---|---|
| 2,616,905 | 3,312,618 |
| 2,723,234 | 3,342,733 |
| 2,777,874 | 3,410,670 |

-continued

| | |
|---|---|
| 2,781,403 | 3,410,671 |
| 3,031,284 | 3,437,465 |
| 3,256,186 | |

These patents are incorporated by reference herein for their disclosures of basic metal salts and their use in lubricants and fuels. Also incorporated herein for the same purpose is German published application 1,243,915.

Most of the basic metal salts heretofore produced and used in lubricants and fuels have been alkaline earth metal salts, especially those of magnesium, calcium and barium. A few patents have suggested that basic alkali metal salts can be produced by similar methods. On the whole, however, there have been few adequately described procedures for producing basic alkali metal salts, and such salts have heretofore not been a major factor in the industry because of their relative unavailability.

The increasing complexity of engines and other units in automotive and similar machinery in recent years has materially increased the demands made on lubricants and fuels used therein. It is now desirable that additives be developed which, in addition to providing detergency and other valuable properties, will impart such advantages as suppression of oil thickening, reduction of oil consumption and preignition, improvement of rust inhibition, and suppression of tendency to stain copper parts and to deposit "lead paint"—that is, a thin film of finely divided lead-containing material from the lead additives in the fuel—on engine parts.

A principal object of the present invention, therefore, is to produce novel compositions of matter.

A further object is to provide a novel process for the preparation of such compositions.

A further object is to produce new basic alkali metal salt-containing compositions which are useful as detergent additives in lubricants and as anti-screen clogging and smoke suppressing additives in fuels.

A still further object is to prepare lubricant additives as described above in the form of clear, filterable, homogeneous solutions or substantially stable dispersions of basic alkali metal salts in such organic media as lubricating oils and normally liquid fuels.

Still another object is to produce such compositions which, in addition to providing detergency when used in lubricants, will inhibit rust formation, reduce oil thickening and oil consumption, and inhibit staining of copper and "lead paint" formation.

Other objects will in part be obvious and will in part appear hereinafter.

The present invention is based on the discovery that basic alkali metal salts having the above-described advantageous properties may be prepared by a specific method set forth in full hereinafter. The metal ratios of the basic salts of this invention are in the range of about 4–40, preferably about 6–30 and especially about 8–25.

Reactant A used in the method of this invention is at least one acidic gaseous material which may be carbon dioxide, hydrogen sulfide or sulfur dioxide; mixtures of these gases are also useful. Carbon dioxide is preferred because of its relatively low cost, availability, ease of use and performance.

Reactant B is a mixture containing at least four components of which component (i) is at least one oil-soluble sulfonic acid, or a derivative thereof susceptible to overbasing. Mixtures of sulfonic acids and/or their derivatives may also be used, but for the sake of simplicity, frequent reference hereinafter will be to the individual sulfonic acids and derivatives which exemplify those which are useful. They may typically be represented by the formulas $R^1(SO_3H)_r$ and $(R^2)_xT(SO_3H)_y$. In these formulas, $R^1$ is an aliphatic or aliphatic-substituted cycloaliphatic hydrocarbon or essentially hydrocarbon radical free from acetylenic unsaturation and containing up to about 60 carbon atoms. When $R^1$ is aliphatic, it usually contains at least about 15–18 carbon atoms; when it is an aliphatic-substituted cycloaliphatic radical, the aliphatic substituents usually contain a total of at least about 12 carbon atoms. Examples of $R^1$ are alkyl, alkenyl and alkoxyalkyl radicals, and aliphatic-substituted cycloaliphatic radicals wherein the aliphatic substituents are alkyl, alkenyl, alkoxy, alkoxyalkyl, carboxyalkyl and the like. Generally, the cycloaliphatic nucleus is derived from a cycloalkane or a cycloalkene such as cyclopentane, cyclohexane, cyclohexene or cyclopentene. Specific examples of $R^1$ are cetylcyclohexyl, laurylcyclohexyl, cetyloxyethyl, octadecenyl, and radicals derived from petroleum, saturated and unsaturated paraffin wax, and olefin polymers including polymerized monoolefins and diolefins containing about 1–8 carbon atoms per olefinic monomer unit. $R^1$ can also contain other substituents such as phenyl, cycloalkyl, hydroxy, mercapto, halo, nitro, amino, nitroso, lower alkoxy, lower alkylmercapto, carboxy, carbalkoxy, oxo or thio, or interrupting groups such as —NH—, —O— or —S—, as long as the essentially aliphatic character thereof is not destroyed.

$R^2$ is generally a hydrocarbon or essentially hydrocarbon radical free from acetylenic unsaturation and containing about 4–60 aliphatic carbon atoms, preferably an aliphatic hydrocarbon radical such as alkyl or alkenyl. It may also, however, contain substituents or interrupting groups such as those enumerated above provided the essentially hydrocarbon character thereof is retained. In general, the non-carbon atoms present in $R^1$ or $R^2$ do not account for more than 10% of the total weight thereof.

The radical T is a cyclic nucleus which may be derived from an aromatic hydrocarbon such as benzene, naphthalene, anthracene or biphenyl, or from a heterocyclic compound such as pyridine, indole or isoindole. Ordinarily, T is an aromatic hydrocarbon nucleus, especially a benzene or naphthalene nucleus.

The subscript x is at least 1 and is generally 1–3. The subscripts r and y have an average value of about 1–4 per molecule and are generally also 1.

Illustrative sulfonic acids useful as component (i) are mahogany sulfonic acids, petrolatum sulfonic acids, mono- and polywax-substituted naphthalene sulfonic acids, cetylchlorobenzene sulfonic acids, cetylphenol sulfonic acids, cetylphenol disulfide sulfonic acids, cetoxycapryl benzene sulfonic acids, dicetyl thianthrene sulfonic acids, di-lauryl beta-naphthol sulfonic acids, dicapryl nitronaphthalene sulfonic acids, paraffin wax sulfonic acids, unsaturated paraffin wax sulfonic acids, hydroxy-substituted paraffin wax sulfonic acids, tetraisobutylene sulfonic acids, tetraamylene sulfonic acids, chloro-substituted paraffin wax sulfonic acids, nitroso-substituted paraffin wax sulfonic acids, petroleum naphthene sulfonic acids, cetylcyclopentyl sulfonic acids, lauryl cyclohexyl sulfonic acids, mono- and polywax-substituted cyclohexyl sulfonic acids, postdodecylbenzene sulfonic acids, "dimer alkylate" sulfonic acids, and the like. These sulfonic acids are well known in the art and require no further discussion herein.

Sulfonic acid derivatives susceptible to overbasing include their metal salts, especially the alkaline earth, zinc and lead salts; ammonium salts and amine salts (e.g., the ethylamine, butylamine and ethylene polyamine salts); and esters such as the ethyl, butyl, and glycerol esters.

For the purpose of this invention, the equivalent weight of a sulfonic acid or derivative thereof is its molecular weight divided by the number of sulfonic acid groups or sulfonic acid derivative groups present therein. Thus, for a monosulfonic acid the equivalent weight is equal to the molecular weight.

Component (ii) is at least one alkali metal selected from sodium and potassium or basic compounds thereof. Of the two alkali metals sodium and/or its compounds are preferred. Illustrative of basic alkali metal compounds are the hydroxides, alkoxides (typically those in which the alkoxy group contains up to 10 and preferably up to 7 carbon atoms), hydrides and amides. Thus, useful basic alkali metal compounds include sodium hydroxide, potassium hydroxide, sodium propoxide, potassium ethoxide, sodium butoxide, sodium hydride, potassium hydride, sodium amide and potassium amide. Especially preferred are sodium hydroxide and the sodium lower alkoxides (i.e., those containing up to 7 carbon atoms). The equivalent weight of component (ii) for the purpose of this invention is equal to its molecular weight, since the alkali metals are monovalent.

Component (iii) is at least one lower aliphatic alcohol, preferably a monohydric or dihydric alcohol. Illustrative alcohols are methanol, ethanol, 1-propanol, 1-hexanol, isopropanol, isobutanol, 2-pentanol, 2,2-dimethyl-1-propanol, ethylene glycol, 1-3-propanediol and 1,5-pentanediol. Of these, the preferred alcohols are methanol, ethanol and propanol, with methanol being especially preferred. The equivalent weight of component (iii) is its molecular weight divided by the number of hydroxy groups per molecule.

Component (iv) is at least one oil-soluble carboxylic acid or functional derivative thereof. Suitable carboxylic acids are those of the formula $R^3(COOH)_n$, wherein n is an integer from 1 to 6 and is preferably 1 or 2 and $R^3$ is a saturated or substantially saturated aliphatic radical (preferably a hydrocarbon radical) having at least 8 aliphatic carbon atoms. Depending upon the value of n, $R^3$ will be a monovalent to hexavalent radical.

Functional derivatives of the acid useful as component (iv) include the anhydrides, esters, amides, imides, amidines and metal salts. Mixtures of the acids and/or functional derivatives are also useful.

$R^3$ may contain non-hydrocarbon substituents provided they do not alter substantially its hydrocarbon character. Such substituents are preferably present in amounts of not more than about 10% by weight. Exemplary substituents include the non-hydrocarbon substituents enumerated hereinabove with reference to component (i). $R^3$ may also contain olefinic unsaturation up to a maximum of about 5% and preferably not more than 2% olefinic linkages based upon the total number of carbon-to-carbon covalent linkages present. The number of carbon atoms in $R^3$ is usually about 8–700 depending upon the source of $R^3$. As discussed below, a preferred series of carboxylic acids and derivatives is prepared by reacting an olefin polymer or halogenated olefin polymer with an $\alpha,\beta$-unsaturated acid or its anhydride such as acrylic, methacrylic, maleic or fumaric acid or maleic anhydride to form the corresponding substituted acid or derivative thereof. The $R^3$ groups in these products have a number average molecular weight in the range of about 150–10,000 and usually about 700–5000.

The monocarboxylic acids useful as component (iv) have the formula $R^3COOH$. Examples of such acids are caprylic, capric, palmitic, stearic, isostearic, linoleic and behenic acids. A particularly preferred group of monocarboxylic acids is prepared by the reaction of a halogenated olefin polymer, such as a chlorinated polybutene, with acrylic acid or methacrylic acid.

Suitable dicarboxylic acids include the substituted succinic acids having the formula $$\begin{array}{l} R^4CHCOOH \\ \quad\;\; | \\ \quad\;\; CH_2COOH \end{array}$$

wherein $R^4$ is the same as $R^3$ as defined above. $R^4$ may be an olefin polymer-derived group formed by polymerization of such monomers as ethylene, propylene, 1-butene, isobutene, 1-pentene, 2-pentene, 1-hexene and 3-hexene. $R^4$ may also be derived from a high molecular weight substantially saturated petroleum fraction. The hydrocarbon-substituted succinic acids and their derivatives constitute the most preferred class of carboxylic acids for use as component (iv).

The above-described classes of carboxylic acids derived from olefin polymers, and their derivatives, are well known in the art, and methods for their preparation as well as representative examples of the types useful in the present invention are described in detail in the following U.S. Pat. Nos.

| | | |
|---|---|---|
| 3,172,892 | 3,316,771 | 3,522,179 |
| 3,216,936 | 3,373,111 | 3,542,678 |
| 3,219,666 | 3,381,022 | 3,542,680 |
| 3,271,310 | 3,341,542 | 3,579,450 |
| 3,272,746 | 3,344,170 | 3,632,510 |
| 3,278,550 | 3,448,048 | 3,632,511 |
| 3,281,428 | 3,454,607 | 3,639,242 |
| 3,306,908 | 3,515,669 | |

Some of the functional derivatives of the above-discussed acids useful as component (iv) are the amides, esters and salts. The reaction products of olefin polymer-substituted succinic acids and mono- or polyamines, particularly polyalkylene polyamines, having up to about ten amino nitrogens are especially suitable. These reaction products generally comprise mixtures of one or more of amides, imides and amidines. The reaction products of polyethylene amines containing up to about 10 nitrogen atoms and polybutene-substituted succinic anhydride wherein the polybutene radical comprises principally isobutene units are particularly useful. These products are disclosed and exemplified in U.S. Pat. Nos. 3,018,250; 3,024,195; 3,172,892; 3,216,936; 3,219,666; and 3,272,746. Included in this group of functional derivatives are the compositions prepared by post-treating the amine-anhydride reaction product with carbon disulfide, boron compounds, nitriles, urea, thiourea, guanidine, alkylene oxides or the like as disclosed and exemplified in U.S. Pat. Nos. 3,200,107; 3,256,185; 3,087,936; 3,254,025; 3,281,428; 3,278,550; 3,312,619; and British Specification 1,053,577. The half-amide, half-metal salt and half-ester, half-metal salt derivatives of such substituted succinic acids are also useful. These products are disclosed in U.S. Pat. Nos. 3,163,603 and 3,522,179.

Also useful are the esters prepared by the reaction of the substituted acids or anhydrides with a mono- or polyhydroxy compound, such as an aliphatic alcohol or a phenol. Typical esters of this type are disclosed in British Specification 981,850 and U.S. Pat. Nos. 3,311,558 and 3,522,179. Preferred are the esters of olefin polymer-substituted succinic acids or anhydrides and polyhydric aliphatic alcohols containing 2-10 hydroxy groups and up to about 40 aliphatic carbon atoms. This class of alcohols includes ethylene glycol, glycerol, sorbitol, pentaerythritol, polyethylene glycol, diethanolamine, triethanolamine, N,N'-di(hydroxyethyl-)ethylene diamine and the like. When the alcohol contains reactive amino groups, the reaction product may comprise products resulting from the reaction of the acid group with both the hydroxy and amino functions. Thus, this reaction mixture can include half-esters, half-amides, esters, amides, and imides, as disclosed in U.S. Pat. No. 3,324,033.

Suitable monocarboxylic acid derivatives and methods for their preparation are disclosed in detail in British Patent Specification 1,075,121 and U.S. Pat. Nos. 3,272,746; 3,340,281; 3,341,542; and 3,342,733.

The foregoing U.S. patents and foreign specifications are incorporated herein by reference for their disclosures of suitable acids and acid-derivatives and the process for their preparation.

The equivalent weight of a compound useful as component (iv) is its molecular weight divided by the number of carboxy groups (or groups derived therefrom) present therein.

The ratios of equivalents of the constituents of reagent B may vary widely. In general, the ratio of component (ii) to (i) is at least 4:1 and usually not more than about 40:1, preferably between 6:1 and 30:1 and most preferably between 8:1 and 25:1. While this ratio may sometimes exceed 40:1, such an excess normally will serve no useful purpose.

The ratio of equivalents of component (iii) to component (i) is between about 1:1 and 80:1, and preferably between about 2:1 and 50:1; and the ratio of equivalents of component (iv) to component (i) is from about 1:1 to about 1:20 and preferably from about 1:2 to about 1:10.

Reagents A and B are generally contacted until there is no further reaction between the two or until the reaction substantially ceases. While it is usually preferred that the reaction be continued until no further overbased product is formed, useful dispersions within the scope of this invention can be prepared when contact between reagents A and B is maintained for a period of time sufficient for about 70% of reagent A, relative to the amount required if the reaction were permitted to proceed to its completion or "end point", to react.

The point at which the reaction is completed or substantially ceases may be ascertained by any of a number of conventional methods. One such method is measurement of the amount of gas (reagent A) entering and leaving the mixture; the reaction may be considered substantially complete when the amount leaving is about 90–100% of the amount entering. These amounts are readily determined by the use of metered inlet and outlet valves.

The reaction temperature is not critical. Generally, it will be between the solidification temperature of the reaction mixture and its decomposition temperature (i.e., the lowest decomposition temperature of any component thereof). Usually, the temperature will be 25°-200° C. and preferably about 50°-150° C. Reagents A and B are conveniently contacted at the reflux temperature of the mixture. This temperature will obviously depend upon the boiling points of the various components; thus, when methanol is used as component (iii), the contact temperature will be about the reflux temperature of methanol.

The reaction is ordinarily conducted at atmospheric pressure, although superatmospheric pressure often expedites the reaction and aromotes optimum utilization of reagent A. The process can also be carried out at reduced pressure but, for obvious practical reasons, this is rarely done.

The reaction is usually conducted in the presence of a substantially inert, normally liquid organic diluent, which functions as both the dispersing and reaction medium. This diluent will comprise at least about 10% of the total weight of the reaction mixture. Ordinarily it will not exceed about 80% by weight, and it is preferably about 30-70% thereof.

Although a wide variety of diluents are useful, it is preferred to use a diluent which is soluble in lubricating oil or normally liquid fuel, particularly when the product is to be used as an additive in a lubricant or fuel. The diluent usually itself comprises a low viscosity lubricating oil or a normally liquid petroleum distillate fuel.

Other organic diluents can be employed either alone or in combination with the lubricating oil or liquid fuel diluent. Preferred diluents for this purpose include the aromatic hydrocarbons such as benzene, toluene and xylene; halogenated derivatives thereof such as chlorobenzene; lower boiling petroleum distillates such as petroleum ether and the various naphthas; normally liquid aliphatic and cycloaliphatic hydrocarbons such as hexane, heptane, hexene, cyclohexene, cyclopentane, cyclohexane and ethylcyclohexane, and their halogenated derivatives. Dialkyl ketones such as dipropyl ketone and ethyl butyl ketone, and the alkyl aryl ketones such as acetophenone, are likewise useful, as are ethers such as n-propyl ether, n-butyl ether, n-butyl methyl ether and isoamyl ether.

When a combination of oil and other diluent is used, the weight ratio of oil to the other diluent is generally from about 1:20 to 20:1. It is usually desirable for a mineral lubricating oil to comprise at least about 50% by weight of the diluent, especially if the product is to be used as a lubricant additive. The total amount of diluent present is not particularly critical since it is inactive. However, the diluent will ordinarily comprise about 10-80% and preferably about 30-70% by weight of the reaction mixture.

The reaction is preferably conducted in the absence of water, although small amounts may be present (e.g., those through the use of technical grade reagents). Water may be present in amounts up to about 10% by weight of the reaction mixture without having harmful effects.

Upon completion of the reaction, any solids in the mixture are preferably removed by filtration or other conventional means. Optionally, readily removable diluents, the alcoholic promoters, and water formed during the reaction can be removed by conventional techniques such as distillation. It is usually desirable to remove substantially all water from the reaction mixture since the presence of water may lead to difficulties in filtration and to the formation of undesirable emulsions in fuels and lubricants. Any such water present is readily removed by heating at atmospheric or reduced pressure or by azeotropic distillation.

The chemical structure of the compositions of this invention is not known with certainty. The basic salts may be solutions or, more likely, stable dispersions. Alternatively, they may be regarded as "polymeric salts" formed by the reaction of the acidic material, the oil-soluble acid being overbased, and the metal compound. In view of the above, these compositions are most conveniently defined by reference to the method by which they are formed.

The oil stable dispersions and the method of preparing them are illustrated by the following examples. Unless otherwise indicated, all parts and percentages are by weight.

EXAMPLE 1

To a solution of 790 parts (1 equivalent) of an alkylated benzenesulfonic acid and 71 parts of polybutenyl succinic anhydride (equivalent weight about 560) containing predominantly isobutene units in 176 parts of mineral oil is added 320 parts (8 equivalents) of sodium hydroxide and 640 parts (20 equivalents) of methanol. The temperature of the mixture increases to 89° C. (reflux) over 10 minutes due to exotherming. During this period, the mixture is blown with carbon dioxide at 4 cfh. (cubic feet/hr.). Carbonation is continued for about 30 minutes as the temperature gradually decreases to 74° C. The methanol and other volatile materials are stripped from the carbonated mixture by blowing nitrogen through it at 2 cfh. while the temperature is slowly increased to 150° C. over 90 minutes. After stripping is completed, the remaining mixture is held at 155°-165° C. for about 30 minutes and filtered to yield an oil solution of the desired basic sodium sulfonate having a metal ratio of about 7.75. This solution contains 12.4% oil.

EXAMPLE 2

Following the procedure of Example 1, a solution of 780 parts (1 equivalent) of an alkylated benzenesulfonic acid and 119 parts of the polybutenyl succinic anhydride in 442 parts of mineral oil is mixed with 800 parts (20 equivalents) of sodium hydroxide and 704 parts (22 equivalents) of methanol. The mixture is blown with carbon dioxide at 7 cfh. for 11 minutes as the temperature slowly increases to 97° C. The rate of carbon dioxide flow is reduced to 6 cfh. and the temperature decreases slowly to 88° C. over about 40 minutes. The rate of carbon dioxide flow is reduced to 5 cfh. for about 35 minutes and the temperature slowly decreases to 73° C. The volatile materials are stripped by blowing nitrogen through the carbonated mixture at 2 cfh. for 105 minutes as the temperature is slowly increased to 160° C. After stripping is completed, the mixture is held at 160° C. for an additional 45 minutes and then filtered to yield an oil solution of the desired basic sodium sulfonate having a metal ratio of about 19.75. This solution contains 18.7% oil.

EXAMPLE 3

Following the procedure of Example 1, a solution of 3120 parts (4 equivalents) of an alkylated benzenesulfonic acid and 284 parts of polybutenyl succinic anhydride in 704 parts of mineral oil is mixed with 1280 parts (32 equivalents) of sodium hydroxide and 2560 parts (80 equivalents) of methanol. This mixture is blown with carbon dioxide at 10 cfh. for about 65 minutes. During this time, the temperature of the mixture increases to 90° C. and then slowly decreases to 70° C. The volatile material is stripped by blowing with nitrogen at 2 cfh. for 2 hours as the temperature of the mixture is slowly increased to 160° C. After stripping is complete, the mixture is held at 160° C. for 0.5 hour, and then filtered to yield a clear oil solution of the desired sodium salt having a metal ratio of 7.75. This solution has a 12.35% oil content.

EXAMPLE 4

Following the procedure of Example 1, a solution of 3200 parts (4 equivalents) of an alkylated benzenesulfonic acid and 284 parts of the polybutenyl succinic anhydride in 623 parts of mineral oil is mixed with 1280 parts (32 equivalents) of sodium hydroxide and 2560 parts (80 equivalents) of methanol. The mixture is blown with carbon dioxide at 10 cfh. for about 77 minutes. During this time the temperature increases to 92° C. and then gradually drops to 73° C. The volatile materials are stripped by blowing with nitrogen gas at 2 cfh. for about 2 hours as the temperature of the reaction mixture is slowly increased to 160° C. The final traces of volatile material are vacuum stripped and the residue is held at 170° C. and then filtered to yield a clear oil solution of the desired sodium salt, having a metal ratio of about 7.72. This solution has an oil content of 11%.

EXAMPLE 5

Following the procedure of Example 1, a solution of 780 parts (1 equivalent) of an alkylated benzenesulfonic acid and 86 parts of the polybutenyl succinic anhydride in 254 parts of mineral oil is mixed with 480 parts (12 equivalents) of sodium hydroxide and 640 parts (20 equivalents) of methanol. The reaction mixture is blown with carbon dioxide at 6 cfh. for about 45 minutes. During this time the temperature increases to 95° C. and then gradually decreases to 74° C. The volatile material is stripped by blowing with nitrogen gas at 2 cfh. for about one hour as the temperature is increased to 160° C. After stripping is complete the mixture is held at 160° C. for 0.5 hour and then filtered to yield an oil solution of the desired sodium salt, having a metal ratio of 11.8. The oil content of this solution is 14.7%.

EXAMPLE 6

Following the procedure of Example 1, a solution of 3120 parts (4.0 equivalents) of an alkylated benzenesulfonic acid and 344 parts of the polybutenyl succinic anhydride in 1016 parts of mineral oil is mixed with 1920 parts (48 equivalents) of sodium hydroxide and 2560 parts (80 equivalents) of methanol. The mixture is blown with carbon dioxide for about two hours at 10 cfh. During this period the temperature increases to 96° C. and then gradually drops to 74° C. The volatile materials are stripped by blowing with nitrogen at 2 cfh. for two hours as the temperature is increased from 74° C. to 160° C. by external heating. The stripped mixture is heated for an additional hour at 160° C. and filtered. The filtrate is vacuum stripped to remove a small amount of water, and again filtered to give a solution of the desired sodium salt, having a metal ratio of about 11.8. The oil content of this.solution is 14.7%.

EXAMPLE 7

Following the procedure of Example 1, a solution of 2800 parts (3.5 equivalents) of an alkylated benzenesulfonic acid and 302 parts of the polybutenyl succinic anhydride in 818 parts of mineral oil is mixed with 1680 parts (42 equivalents) of sodium hydroxide and 2240 parts (70 equivalents) of methanol. The mixture is blown with carbon dioxide for about 90 minutes at 10 cfh. During this period, the temperature increases to 96° C. and then slowly drops to 76° C. The volatile materials are stripped by blowing with nitrogen at 2 cfh. as the temperature is slowly increased from 76° C. to 165° C. by external heating. Water is removed by vacuum stripping. Upon filtration, an oil solution of the desired basic sodium salt is obtained. It has a metal ratio of about 10.8 and the oil content is 13.6%.

EXAMPLE 8

Following the procedure of Example 1, a solution of 780 parts (1.0 equivalent) of an alkylated benzenesulfonic acid and 103 parts of the polybutenyl succinic anhydride in 350 parts of mineral oil is mixed with 640 parts (16 equivalents of sodium hydroxide and 640 parts (20 equivalents) of methanol. This mixture is blown with carbon dioxide for about one hour at 6 cfh. During this period, the temperature increases to 95° C. and then gradually decreases to 75° C. The volatile material is stripped by blowing with nitrogen. During stripping, the temperature initially drops to 70° C. over 30 minutes and then slowly rises to 78° C. over 15 minutes. The mixture is then heated to 155° C. over 80 minutes. The stripped mixture is heated for an additional 30 minutes at 155°-160° C. and filtered. The filtrate is an oil solution of the desired basic sodium sulfonate, having a metal ratio of about 15.2. It has an oil content of 17.1%.

EXAMPLE 9

Following the procedure of Example 1, a solution of 2400 parts (3.0 equivalents) of an alkylated benzenesulfonic acid and 308 parts of the polybutenyl succinic anhydride in 991 parts of mineral oil is mixed with 1920 parts (48 equivalents) of sodium hydroxide and 1920 parts (60 equivalents) of methanol. The mixture is blown with carbon dioxide at 10 cfh. for 110 minutes, during which time the temperature rises to 98° C. and then slowly decreases to 76° C. over about 95 minutes. The methanol and water are stripped by blowing with nitrogen at 2 cfh. as the temperature of the mixture slowly increases to 165° C. The last traces of volatile material are vacuum stripped and the residue is filtered to yield an oil solution of the desired sodium salt having a metal ratio of 15.1. The solution has an oil content of 16.1%.

EXAMPLE 10

Following the procedure of Example 1, a solution of 780 parts (1 equivalent) of an alkylated benzenesulfonic acid and 119 parts of the polybutenyl succinic anhydride in 442 parts of mineral oil is mixed well with 800 parts (20 equivalents) of sodium hydroxide and 640 parts (20 equivalents) of methanol. This mixture is blown with carbon dioxide for about 55 minutes at 8 cfh. During this period, the temperature of the mixture increases to 95° C. and then slowly decreases to 67° C. The methanol and water are stripped by blowing with nitrogen at 2 cfh. for about 40 minutes while the temperature is slowly increased to 160° C. After stripping, the temperature of the mixture is maintained at 160°-165° C. for about 30 minutes. The product is then filtered to give a solution of the corresponding sodium sulfonate having a metal ratio of about 16.8. This solution contains 18.7% oil.

EXAMPLE 11

Following the procedure of Example 1, 836 parts (1 equivalent) of a sodium petroleum sulfonate (sodium "Petronate") in an oil solution containing 48% oil and 63 parts of the polybutenyl succinic anhydride is heated to 60° C. and treated with 280 parts (7.0 equivalents) of sodium hydroxide and 320 parts (10 equivalents) of methanol. The reaction mixture is blown with carbon dioxide at 4 cfh. for about 45 minutes. During this time, the temperature increases to 85° C. and then slowly decreases to 74° C. The volatile material is stripped by blowing with nitrogen at 2 cfh. while the temperature is gradually increased to 160° C. After stripping is completed, the mixture is heated an additional 30 minutes at 160° C., and then is filtered to yield the sodium salt in solution. The product has a metal ratio of 8.0 and an oil content of 22.2%.

EXAMPLE 12

Following the procedure of Example 11, 1256 parts (1.5 equivalents) of the sodium petroleum sulfonate in an oil solution containing 48% oil and 95 parts of polybutenyl succinic anhydride is heated to 60° C. and treated with 420 parts (10.5 equivalents) of sodium hydroxide and 960 parts (30 equivalents) of methanol. The mixture is blown with carbon dioxide at 4 cfh. for 60 minutes. During this time, the temperature is increased to 90° C. and then slowly decreases to 70° C. The volatile materials are stripped by blowing with nitrogen and slowly increasing the temperature to 160° C. After stripping, the reaction mixture is allowed to stand at 160° C. for 30 minutes and then is filtered to yield an oil solution of sodium sulfonate having a metal ratio of about 8.0. The oil content of the solution is 22.2%.

As previously indicated, the dispersions of this invention are principally useful as additives for lubricants, in which they function primarily as detergents. When used as such in crankcase lubricants, for example, they promote engine cleanliness and reduce wear by neutralizing acidic contaminants such as those formed by oxidation of the oil components or during combustion. These acidic contaminants, if not neutralized, will lead to increased engine wear and the formation of lacquer on engine parts. The dispersions of this invention also disperse insoluble materials formed in lubricants as a result of fuel combustion or oil oxidation, and accordingly reduce sludge formation.

Additional beneficial properties imparted to lubricants by the dispersions of this invention are inhibition of rust and "lead paint" formation and staining, reduction of oil thickening and oil consumption, and reduction of the preignition tendency in gasoline engines. Reduction of oil consumption and preignition may be effected by replacing conventional basic alkaline earth metal salt dispersions by the present dispersions in full or in part.

The dispersions of this invention can be employed in a variety of lubricants based on diverse oils of lubricating viscosity, including natural and synthetic lubricating oils and mixtures thereof. These lubricants include crankcase lubricating oils for spark-ignited and compression-ignited internal combustion engines, including automobile and truck engines, two-cycle engines, aviation piston engines, marine and railroad diesel engines, and the like. They can also be used in gas engines, stationary power engines and turbines and the like. Automatic transmission fluids, transaxle lubricants, gear lubricants, metal-working lubricants, hydraulic fluids and other lubricating oil and grease compositions can also benefit from the incorporation therein of the compositions of the present invention.

Natural oils include animal oils and vegetable oils (e.g., castor oil, lard oil) as well as liquid petroleum oils and solvent-treated or acid-treated mineral lubricating oils of the paraffinic, naphthenic or mixed paraffinic-naphthenic types. Oils of lubricating viscosity derived from coal or shale are also useful base oils. Synthetic lubricating oils include hydrocarbon oils and halosubstituted hydrocarbon oils such as polymerized and interpolymerized olefins [e.g., polybutylenes, polypropylenes, propylene-isobutylene copolymers, chlorinated polybutylenes, poly(1-hexenes), poly(1-octenes), poly(1-decenes), etc. and mixtures thereof]; alkylbenzenes (e.g., dodecylbenzenes, tetradecylbenzenes, dinonylbenzenes, di(2-ethylhexyl)benzenes, etc.); polyphenyls (e.g., biphenyls, terphenyls, alkylated polyphenyls, etc.), alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc. constitute another class of known synthetic lubricating oils. These are exemplified by the oils prepared through polymerization of ethylene oxide or propylene oxide, the alkyl and aryl ethers of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500, etc.) or mono- and polycarboxylic esters thereof, for example, the acetic acid esters, mixed $C_3$–$C_8$ fatty acid esters, or the $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2ethylhexyl) silicate, tetra-(4-methyl-2-ethylhexyl) silicate, tetra-(p-tert-butylphenyl) silicate, hexa-(4-methyl- 2-pentoxy)-disiloxane, poly(methyl)siloxanes, poly(methylphenyl)siloxanes, etc.). Other synthetic lubricating oils include liquid esters of phosphorus-containing acids (e.g., tricresyl phosphate, trioctyl phosphate, diethyl ester of decylphosphonic acid, etc.), polymeric tetrahydrofurans and the like.

Unrefined, refined and rerefined oils (and mixtures of each with each other) of the type disclosed hereinabove can be used in the lubricant compositions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more properties. Many such purification techniques are known to those of skill in the art such as solvent extraction, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

Generally, the lubricants of the present invention contain an amount of the composition of this invention sufficient to provide it with the advantageous properties mentioned hereinabove, especially detergency. Normally this amount will be about 0.001–30% by weight. Most often, an amount is used to provide a sulfate ash content in the lubricant of about 0.01–20%, preferably about 0.1–10%. If the lubricant is for use in the crankcase of a gasoline engine, it will normally contain about 1% ash. For diesel engines about 0.1–5% ash is required, and in marine diesel engines at least about 10% ash may be necessary.

The invention also contemplates the use of other additives in combination with the dispersions of this invention. Such additives include, for example, auxiliary detergents and dispersants of the ash-producing or ashless type, corrosion- and oxidation-inhibiting agents, pour point depressing agents, extreme pressure agents, color stabilizers and anti-foam agents.

The ash-producing detergents are exemplified by oil-soluble neutral and basic salts of alkaline earth metals with sulfonic acids, carboxylic acids, or organic phosphorus acids characterized by at least one direct carbon-to-phosphorus linkage such as those prepared by the treatment of an olefin polymer (e.g., polyisobutene having a molecular weight of 1000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The most commonly used salts of such acids are those of calcium, magnesium, strontium and barium. They are known in the art and described in a number of patents, some of which are referred to hereinabove.

Auxiliary ashless detergents and dispersants are so called despite the fact that, depending on its constitution, the dispersant may upon combustion yield a nonvolatile material such as boric oxide or phosphorus pentoxide; however, it does not ordinarily contain metal and therefore does not yield a metal-containing ash on combustion. Many types are known in the art; these include the esters, amides, imides, amidines and metal salts described hereinabove with reference to component (iv), which are referred to hereinafter as "carboxylic dispersants". Other suitable dispersants include:

(1) Reaction products of relatively high molecular weight aliphatic or alicyclic halides with amines, preferably polyalkylene polyamines. These may be characterized as "amine dispersants" and examples thereof are described for example, in the following U.S. Pat. Nos.:

| | |
|---|---|
| 3,275,554 | 3,454,555 |
| 3,438,757 | 3,565,804 |

(2) Reaction products of alkyl phenols in which the alkyl group contains at least about 30 carbon atoms with aldehydes (especially formaldehyde) and amines (especially polyalkylene polyamines), which may be characterized as "Mannich dispersants". The materials described in the following U.S. Pat. Nos. are illustrative.

| | |
|---|---|
| 3,413,347 | 3,725,480 |
| 3,697,574 | 3,726,882 |
| 3,725,277 | |

(3) Products obtained by post-treating the carboxylic, amine or Mannich dispersants with such reagents as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. Pat. Nos.:

| | | | |
|---|---|---|---|
| 3,036,003 | 3,282,955 | 3,493,520 | 3,639,242 |
| 3,087,936 | 3,312,619 | 3,502,677 | 3,649,229 |
| 3,200,107 | 3,366,569 | 3,513,093 | 3,649,659 |
| 3,216,936 | 3,367,943 | 3,533,945 | 3,658,836 |
| 3,254,025 | 3,373,111 | 3,539,633 | 3,697,574 |
| 3,256,185 | 3,403,102 | 3,573,010 | 3,702,757 |
| 3,278,550 | 3,442,808 | 3,579,450 | 3,703,536 |
| 3,280,234 | 3,455,831 | 3,591,598 | 3,704,308 |
| 3,281,428 | 3,455,832 | 3,600,372 | 3,708,522 |

(4) Interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. These may be characterized as "polymeric dispersants" and examples thereof are disclosed in the following U.S. Pat. Nos.:

| | |
|---|---|
| 3,329,658 | 3,666,730 |
| 3,449,250 | 3,687,849 |
| 3,519,565 | 3,702,300 |

The above-noted patents are incorporated by reference herein for their disclosures of ashless dispersants.

Extreme pressure agents and corrosion- and oxidation-inhibiting agents are exemplified by chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate; phosphorus esters including principally dihydrocarbon and trihydrocarbon phosphites such as dibutyl phosphite, diheptyl phosphite, dicyclohexyl phosphite, pentyl phenyl phosphite, dipentyl phenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate; Group II metal phosphorodithioates such as zinc dicyclohexylphosphorodithioate, zinc dioctylphosphorodithioate, barium di(heptylphenyl)phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

In fuel compositions such as petroleum distillate fuels, the dispersions of this invention promote engine cleanliness particularly to the components of the fuel system, such as fuel lines, carburetors, injectors and pumps. In furnace fuel oils, they serve as anti-screen clogging agents. In diesel fuels and other fuels which tend to produce black exhaust smoke upon combustion, the subject salt dispersions tend to suppress the formation and evolution of such smoke.

The fuel compositions of the present invention contain a major proportion of a normally liquid fuel, usually a hydrocarbonaceous petroleum distillate fuel such as motor gasoline as defined by ASTM Specification D439-73 or diesel fuel or fuel oil as defined by ASTM Specification D396. Normally liquid fuel compositions comprising nonhydrocarbonaceous materials such as alcohols, ethers, organo-nitro compounds and the like (e.g., methanol, ethanol, diethyl ether, methyl ethyl ether, nitromethane) are also within the scope of this invention as are liquid fuels derived from vegetable or mineral sources such as corn, alfalfa, shale and coal. Normally liquid fuels which are mixtures of one or more hydrocarbonaceous fuels and one or more nonhydrocarbonaceous materials are also contemplated. Examples of such mixtures are combinations of gasoline and ethanol or of diesel fuel and ether. Particularly preferred is gasoline, that is, a mixture of hydrocarbons having an ASTM boiling point of about 60° C. at the 10% distillation point to about 205° C. at the 90% distillation point.

When the dispersions of this invention are added to fuels as anti-screen clogging agents, they will normally be employed in an amount such that the sulfate ash content of the fuel will be about 0.0001–0.1% by weight. If the dispersion is used in a diesel fuel to suppress the formation of smoke, enough additive should be added to impart a sulfate ash content of about 0.001–1%, preferably about 0.05–0.5%.

The fuel compositions can contain, in addition to the dispersions of this invention, other additives which are well known to those of skill in the art. These can include antiknock agents such as tetra-alkyl lead compounds, lead scavengers such as halo-alkanes (e.g., ethylene dichloride and ethylene dibromide), deposit preventers or modifiers such as triaryl phosphates, dyes, cetane improvers, anti-oxidants such as 2,6-di-tertiary-butyl-4-methylphenol, rust inhibitors such as alkylated succinic acids and anhydrides, bacteriostatic agents, gum inhibitors, metal deactivators, demulsifiers, upper cylinder lubricants, anti-icing agents and the like.

The dispersions of this invention can be added directly to the lubricant or fuel. Preferably, however, they are diluted with a substantially inert, normally liquid organic diluent such as those mentioned hereinabove, particularly mineral oil, naphtha, benzene, toluene or xylene, to form an additive concentrate. These concentrates usually contain about 20–90% by weight of the dispersion of this invention and may contain, in addition, one or more other additives known in the art or described hereinabove.

The following examples illustrate lubricant and fuel compositions containing the dispersions of this invention. Unless otherwise indicated, all percentages and parts are by weight.

EXAMPLE A

A composition for use as an automatic transmission fluid is prepared using an ATF base oil plus 12.36% total additives. These additives are added as a concentrate which contains 3% of a conventional commercial seal sweller; 3.25% of a viscosity index improver derived from mixed esters of a styrene-maleic acid interpolymer as disclosed in U.S. Pat. No. 3,702,300; 4% of a dispersant which is the reaction product (1:1 equivalents) of polyisobutenyl succinic anhydride and tetraethylene pentamine, prepared according to the procedure of U.S. Pat. No. 3,172,892; 0.71% of a zinc isobutylamyl phosphorodithioate oxidation inhibitor; 1% of the product of Example 1; 0.2% of a conventional friction modifier based upon polyoxyethylene(2) tallow amine (Ethomeen T/12); 0.2% of mineral oil; 200 ppm. of a conventional silicone based anti-foam agent; and 0.025% of a dye.

EXAMPLE B

A lubricating composition is prepared using a SAE 90 base oil, 20% by volume of the product of Example 5, and 50 ppm. of a conventional silicone based anti-foam agent.

EXAMPLE C

A lubricating composition is prepared using a SAE 30 base oil, and as additives, 4% by volume of a dispersant based upon the reaction product of a polyisobutylene succinic anhydride, pentaerythritol, a poly(oxy ethylene)-(oxypropylene)glycerol, and polyethylene polyamine, as described in Example 11B of British Patent 1,306,529; 0.5% by volume of a commercial demulsifier; 0.1% zinc as zinc isobutyl-p-amyl phosphorodithioate as an oxidation inhibitor; and 2.5% of the product of Example 8.

EXAMPLE D

A lubricating composition is prepared using a SAE 20 base oil, and, as additives, 0.2% of a commercial acrylate based pour point depressant; 4.5% by volume of the dispersant described in Example C; 0.57% of the oxidation inhibitor described in Example C; 0.5% sulfate ash as the product of Example 1; and 40 ppm. of a conventional silicone based anti-foaming agent.

EXAMPLE E

A lubricating composition is prepared using a SAE 30 base oil, and, as additives, 2.45% by volume of the product of Example 1; 1% by volume of the dispersant described in Example A; 0.6% by volume of the oxidation inhibitor described in Example C; and 30 ppm. of a conventional silicone based anti-foam agent.

EXAMPLE F

A lubricating composition is prepared using a SAE 30 base oil, and, as additives, 4% by volume of the dispersant described in Example C; 0.5% of a commercial demulsifier; 0.1% zinc as zinc isobutyl-p-amyl phosphoro dithioate as an oxidation inhibitor; and 3.17% of the product of Example 10.

EXAMPLE G

A lubricating composition is prepared using a SAE 10W-30 base oil, and, as additives, 5.75% of a combination pour point depressant and viscosity index improver based upon a mixture of a fumaric-vinyl acetate-ethyl vinyl ether copolymer (as described in U.S. Pat. No. 3,250,715) and a polyacrylate; 4.5% by volume of the dispersant described in Example C; 0.57% of the oxidation inhibitor described in Example F; and 0.5% sulfate ash as the product of Example 10.

EXAMPLE H

A lubricating composition is prepared using a 100N base oil and a total of 13.36% additives including 3.75% of the viscosity index improver described in Example A; 3.5% of a commercial seal sweller; 4% by volume of the dispersant described in Example A; 0.71% of a zinc dioctyl phosphorodithioate oxidation inhibitor; 0.2% of the friction modifier described in Example A; 0.2% mineral oil; and 1% of the product of Example 3.

EXAMPLE J

A lubricating composition is prepared using a SAE 20 base oil and, as additives, 4.5% of the demulsifier described in Example C; 0.57% of the oxidation inhibitor described in Example C; 0.25% sulfate ash as an overbased magnesium petroleum sulfonate; 0.25% sulfate ash as the product of Example 1; 0.2% of a conventional commercial pour point depressant (Acryloid 150); and 30 ppm. of a conventional silicone based anti-foam agent.

EXAMPLE K

A lubricating composition is prepared using a SAE 10W base oil and, as additives, 12% of a commercial viscosity index improver; 3.42% of a dispersant comprising the 1:1 mole reaction product of a polyisobutenyl succinic anhydride and pentaerythritol; 1.05% of a dispersant comprising the reaction product of a polyisobutenyl succinic anhydride and the reaction product of adipic acid and aminoethyl ethanolamine; 0.12% of a commercial demulsifier; 1.73% of the product of Example 2; 1.63% of zinc methylethyl phosphorodithioate, and 50 ppm. of a silicone based anti-foam agent.

EXAMPLE L

A lubricating composition is prepared using a 10W-50 base oil and, as additives, 8.4% of a hydrogenated butadiene-styrene viscosity index improver; 7.25% of the product of Example 2; 2% by volume of the dispersant described in Example C; and 0.1% of a conventional pour point depressant (PAM-140).

EXAMPLE M

A lubricating composition is prepared using a synthetic lubricating oil base consisting essentially of the diethyl ether of polypropylene glycol having an average molecular weight of about 1500, and 1% of the product of Example 1.

EXAMPLE N

A diesel fuel composition is prepared containing 1% of the product of Example 8 and 100 ppm. of a conventional silicone based anti-foam agent.

EXAMPLE P

A jet aviation fuel composition is prepared containing 0.25% of the product of Example 1 and 100 ppm. of a conventional anti-foam agent.

EXMPLE Q

Three gasoline fuel compositions are prepared using the product of Example 1 as the additive in concentrations of 67.5 pounds, 33.75 pounds, and 1000 pounds per 1000 barrels (42 U.S. gallons per barrel) of gasoline.

As stated earlier, one of the significant characteristics realized from lubricants comprising one or more of the oil stable dispersions of the present invention is their ability to reduce internal combustion engines oil consumption. A well known test utilized by the industry to determine, inter alia, oil consumption is Oldsmobile Sequence IIIC Test (described in ASTM publication STP 315F "Multicylinder Test Sequences for Evaluating Automotive Engine Oils" at pages 53-111.) This IIIC Test which utilizes high speed turnpike operation under relatively high ambient conditions typical of the southern and southwestern parts of the United States involves operating an Oldsmobile V-8 engine for a predetermined period under non-cyclic, moderately high speed, high load and high temperature conditions, with oil level checks and oil additions every 8 hours. The maximum permitted oil consumption after 64 hours, according to the industry standard, is 5.88 quarts.

Three lubricants are tested, each comprising a 10W-30 mineral oil base and containing identical amounts of conventional additives including an amide-imide type ashless dispersant derived from polybutenyl succinic acid, an ethylene-propylene terpolymer viscosity index improver, zinc dialkylphosphorodithioates, a silicone anti-foam agent, and a synthetic sulfurized product having properties similar to those of sulfurized sperm oil. In addition, the lubricants contain alkali metal and/or alkaline earth metal detergents in an amount to provide 0.75% (by weight) metal sulfate ash, said amount being distributed as follows:

Lubricant 1—0.30% as the product of Example 2; 0.45% as a basic calcium sulfonate having a metal ratio of about 12.25.

Lubricant 2—0.75% as the basic calcium sulfonate of lubricant 1.

Lubricant 3—0.75% as a basic calcium sulfonate prepared as the one described in Lubricant 1 but having a metal ratio of about 20:1.

Thus, the detergents in Lubricants 2 and 3 are entirely the previously known basic calcium detergents, while the detergent of Lubricant 1 is in part a basic sodium detergent of the present invention.

The oil consumption figures (in quarts) for the above lubricants after a test duration of 64 hours are as follows:

| | Lubricant 1 | Lubricant 2 | Lubricant 3 |
|---|---|---|---|
| Run 1 | 4.50 | 5.20 | 5.58 |

-continued

| | Lubricant 1 | Lubricant 2 | Lubricant 3 |
|---|---|---|---|
| Run 2 | 4.80 | — | 5.39 |
| Run 3 | 4.23 | — | — |
| Av. | 4.51 | 5.20 | 5.49 |

Lubricant 1 provides a reduction in oil consumption of 13+% over Lubricant 2 and 18+% over Lubricant 3.

In another series two lubricants are tested, each comprising identical amounts of conventional additives including an amide-imide type ashless dispersant derived from polybutenyl succinic acid, styrenated succinic acid ester as viscosity index improver, zinc dialkyl phosphorodithioates, a silicone antifoam agent, and a synthetic sulfurized product having properties similar to those of sulfurized sperm oil. Also, these lubricants contain alkali metal and/or alkaline earth metal detergents in an amount to provide 0.75% (by weight) metal sulfate ash, said amount being distributed as follows:

Lubricant 4—0.30% as the product of Example 2 of the invention, 0.45% as a basic calcium sulfonate having a metal ratio of about 12.25.

Lubricant 5—0.75% as the basic calcium sulfonate of Lubricant 4.

The following results (single test in each instance) are obtained:

Lubricant 4—4.83 quarts.

Lubricant 5—5.66 quarts.

Lubricant 4 shows a reduction of 14.6% over Lubricant 5.

It will be apparent from these results that replacement of part of the conventional basic calcium detergent in a lubricant by a basic sodium detergent results in a significant decrease in oil sonsumption.

A second test procedure is conducted to determine the effects of lubricants containing overbased alkali metal sulfonates on "lead paint" deposits on engine parts. Leaded fuels are notorious for forming undesirable gray deposits known as "gray paint" or "lead paint".

The test uses a single cylinder engine [known as a CLR (Committee on Lubricant Research) engine which was developed by the Coordinating Research Council of the Society of Automotive Engineers (SAE)] burning leaded fuel and lubricated with the lubricants under consideration. The test is run for a total of sixty hours after which the various engine parts are rated visually for "lead paint".

In this series three lubricants, 6, 7 and 8 are used; each comprising identical amounts of conventional additives including a polyol ester type ashless dispersant derived from polybutenyl succinic acid, hydrogenated buta diene-styrene copolymer as viscosity index. improver, zinc dialkyl phosphorodithioates, a pour point depressing agent, and a silicone anti-foam agent. These lubricants contain alkali metal or alkaline earth metal detergents in an amount to provide 0.58% (by weight) metal sulfonate ash, said amount being distributed as follows:

Lubricant 6—0.58% of basic calcium sulfonate having a metal ratio of about 12.25.

Lubricant 7—0.58% of basic magnesium sulfonate having a metal ratio of about 11.0.

Lubricant 8—0.58% of basic sodium sulfonate as prepared in Example 2 above.

The following results are obtained:

| | Engine Rating 50 = Clean | Piston Rating* 10 = Clean |
|---|---|---|
| Lubricant 6 | 37.2 | 8.8 |
| Lubricant 7 | 38.5 | 8.7 |
| Lubricant 8 | 48.4 | 9.3 |

From the above it is quite apparent that the basic sodium salt is significantly more effective in reducing "lead paint" than either the basic calcium or magnesium sulfonates.

What is claimed is:

1. A stable oil-soluble dispersion of sodium sulfonate having a metal ratio of at least about 4, prepared by a method which comprises intimately contacting for a period of time sufficient to form the desired dispersion, at a temperature between the solidification temperature of the reaction mixture and its decomposition temperature:

(A) at least one acidic gaseous material selected from the group consisting of carbon dioxide, hydrogen sulfide, sulfur dioxide, and mixtures thereof, with (B) a mixture comprising (i) at least one oil-soluble aliphatic-substituted benzenesulfonic acid having at least about 12 carbon atoms in the aliphatic substituent;

(ii) sodium or a hydroxide, alkoxide, hydride or amide thereof;

(iii) at least one lower aliphatic alcohol; and (iv) at least one oil-soluble aliphatic-substituted succinic acid or anhydride wherein the aliphatic substituent is saturated, or substantially saturated, and has a number average molecular weight in the range form about 700 to about 5000;

the ratios of equivalents of the components of reactant (B) being:

(ii)/(i)—at least 4:1;

(iii)/(i)—between about 1:1 and about 80:1:

(iv)/(i)—between about 1:2 and about 1.20.

2. A dispersion according to claim 1 wherein reactant (A) is carbon dioxide.

3. A dispersion according to claim 2 wherein the reaction temperature is in the range of about 25°-200° C.

4. A dispersion according to claim 3 wherein component (i) is an acid represented by one of the formulae $R^1(SO_3H)_r$ or $(R^2)_xT(SO_3H)_y$ in which $R^1$ and $R^2$ are each independently an aliphatic radical free from acetylenic unsaturation and containing up to 60 carbon atoms, T is a phenyl group, x is a number form 1 to 3, and r and y are numbers from 1 to 4.

5. A dispersion according to claim 4 wherein component (i) is an alkylated benzenesulfonic acid.

6. A dispersion according to claim 1 wherein component (iii) is at least one lower alkanol and the ratios of equivalents of the components of reactant (B) are:

(ii)/(i)—between about 6:1 and about 40:1;

(iii)/(i)—between about 2:1 and about 50:1;

(iv)/(i)—between 1:2 and about 1:10.

7. A dispersion according to claim 6 wherein component (iii) is at least one of methanol, ethanol, propanol, butanol and pentanol and component (iv) is at least one of polybutenyl succinic acid and polybutenyl succinic anhydride wherein the polybutenyl group comprises principally isobutene units and has a number average molecular weight between about 700 and about 10,000.

8. A dispersion accoding to claim 6 wherein component (ii) is sodium hydroxide or a sodium alkoxide and component (iii) is methanol.

9. A stable oil-soluble dispersion of basic sodium sulfonate having a metal ratio fo about 6 to about 30 prepared by the method which comprises intimately contacting for a sufficient time, at a temperature between about 50° C. to about 150° C., carbon dioxide with a mixture consisting essentially of (i) at least one oil-soluble alkylated benzene sulfonic acid, (ii) sodium hydroxide, (iii) methanol, and (iv) at least one oil-soluble polybutenyl substituted succinic anhydride wherein the polybutenyl substituent has a nubmer average molecular weight of 700–5000;

the ratios of equivalents of components being:

(ii)/(i)—between about 6:1 and about 30:1;

(iii)/(i)—between about 2:1 and about 50:1;

(iv)/(i)—between about 1:2 and about 1:10.

10. An additive concentrate comprising a substantially inert, normally liquid diluent and from about 20% to about 90% by weight of a dispersion according to any of claims 1–5, 6, 7 8 or 9.

11. A lubricating composition comprising a major amount of a lubricating oil and a minor amount of a dispersion according to any of claims 1–5, 6, 7, 8 or 9 said minor amount being sufficient to provide detergency, inhibit rust or "lead paint" formation, reduce oil thickening or oil consumpton, or reduce preignition tendency.

12. A lubricating composition according to claim 11 which additionally contains a minor amount of at least one neutral or basic alkaline earth metal salt of a sulfonic acid, carboxylic acid or organic phosphorus acid.

* * * * *